US010167647B1

(12) United States Patent
Pierre

(10) Patent No.: US 10,167,647 B1
(45) Date of Patent: Jan. 1, 2019

(54) MODULAR STRUCTURE FOR EXTENSION OVER A POOL

(71) Applicant: Laurinus Pierre, North Miami, FL (US)

(72) Inventor: Laurinus Pierre, North Miami, FL (US)

( * ) Notice: Subject to any disclaimer, the term of this patent is extended or adjusted under 35 U.S.C. 154(b) by 0 days.

(21) Appl. No.: 16/052,594

(22) Filed: Aug. 1, 2018

Related U.S. Application Data

(60) Provisional application No. 62/539,655, filed on Aug. 1, 2017.

(51) Int. Cl.
*E04H 4/00* (2006.01)
*E04H 4/08* (2006.01)

(52) U.S. Cl.
CPC ..... *E04H 4/084* (2013.01)

(58) Field of Classification Search
CPC ..... E04H 4/084; E04H 4/082; E04H 4/08
USPC ..... 4/498
See application file for complete search history.

(56) References Cited

U.S. PATENT DOCUMENTS 3,495,279 A * 2/1970 Regan ..... E04H 4/08 4/494
4,683,686 A * 8/1987 Ozdemir ..... E04H 3/165 52/63
5,426,899 A * 6/1995 Jones ..... E04B 7/14 135/908
5,921,030 A * 7/1999 Ducotey ..... E04H 4/08 52/23
2007/0130680 A1* 6/2007 Kolechstein ..... E04H 4/08 4/498
2014/0208501 A1* 7/2014 Black ..... E04B 1/342 4/503

* cited by examiner

*Primary Examiner* — Huyen Le

(57) ABSTRACT

There is provided a structure for extending over a pool. The structure includes a first section secured to a second section at at least two locations. Each of the first section and the second section may include two longitudinal members joined by a set of transversally-disposed lateral members. Furthermore, the first section and the second section further includes a set of transparent members disposed in a longitudinal direction overtop the set of transversally-disposed lateral members. Furthermore, the set of transparent members form a continuous platform secured by a set of stops disposed at each end of the two longitudinal members. The first and second section may be secured using a set of bolts, pins, screws, or combinations thereof.

20 Claims, 10 Drawing Sheets

MODULAR STRUCTURE FOR EXTENSION OVER A POOL

CROSS-REFERENCE TO RELATED APPLICATIONS

The present disclosure claims the benefit of U.S. Provisional Patent Application No. 62/539,655, which was filed on Aug. 1, 2017, and the content of which is incorporated herein in its entirety by reference.

BACKGROUND

The present disclosure relates to modular structures including, without limitation, modular platforms for extension over swimming pools. The background description provided herein is for the purpose of generally presenting the context of the disclosure. The work of the presently named inventor, to the extent it is described in this background section, as well as aspects of the description that may not otherwise qualify as prior art at the time of filing are neither expressly nor impliedly admitted as prior art against the present disclosure.

In a wide variety of situations, there may arise a need for a structure that can be assembled over a pool. Such a structure may provide a standing surface that was not otherwise present. For instance, in a home having a swimming pool in its backyard, a homeowner may wish to cover the pool with a structure in order to create a surface onto which guests can stand or sit at a table disposed thereon. The structure effectively allows the homeowner to reclaim backyard area that is inherently lost because of the swimming pool. In other words, with the addition of the structure, the homeowner effectively provides a surface over the pool for guests to walk and/or stand on.

Typically, to achieve such a conversion, the homeowner may hire a contractor to build a platform over the swimming pool. The platform may be made of wood beams that are nailed or screwed together and extend laterally to form a frame over the pool. More wood beams may then be nailed on top of the frame to create the surface. Additionally, support beams may extend vertically below the frame and into the pool to provide support for the frame. In other typical situations, the above-described structure may be made with metal rather than with wood.

While the aforementioned structures each adequately provides a surface for covering the pool they have several drawbacks. First, they require intensive labor and expert knowledge to install. Second, once installed, the pool may not be usable because of the support structures extending into the pool to support the frame. Third, the structures are typically tailor-made for a specific pool size and design, and thus, they may not be usable with a wide variety of pools. And, fourth, should the homeowner decide to remove the structure to make use the pool, any subsequent need for the structure would require a complete re-installation with new wood beams, which would significantly increase costs. As such, these typical structures are costly, which has impeded their widespread adoption.

SUMMARY

The embodiments featured herein help mitigate or solve one or more or all of the aforementioned problems. For example, in their structural configuration, the embodiments provide a modular structure that may be easily installed over a pool without the need for expert technicians. Further, the modular structure may be dismantled and stored with as much ease as it requires to assemble it. Furthermore, in one or more embodiments described herein, a modular structure does not require support structures that extend into the pool. As such, the pool may still be usable with the exemplary modular structure disposed on top of it.

In addition to the aforementioned advantages, a modular structure according to an embodiment described herein can be used with a wide variety of pool sizes and designs. This is achieved with the aid of modular tiles and sections thereof that can be assembled to fit on top of a particular pool. Moreover, a modular structure according to an embodiment may be disassembled and stored and subsequently reinstalled.

In one embodiment which has some or all of the advantages described above, there is provided a structure for extending over a pool. The structure includes a first section secured to a second section at at least two locations. Each of the first section and the second section may include two longitudinal members joined by a set of transversally-disposed lateral members. Furthermore, the first section and the second section further includes a set of transparent members disposed in a longitudinal direction overtop the set of transversally-disposed lateral members. Furthermore, the set of transparent members form a continuous platform secured by a set of stops disposed at each end of the two longitudinal members. The first and second section may be secured using a set of bolts, pins, screws, or combinations thereof.

DETAILED DESCRIPTION

Embodiments will be described below in more detail with reference to the accompanying drawings. The following detailed descriptions are provided to assist the reader in gaining a comprehensive understanding of the methods, apparatuses, and/or arrangements described herein as well as modifications thereof. Accordingly, various modifications and equivalents of the methods, apparatuses, and/or arrangements described herein will be apparent to those of ordinary skill in the art. Descriptions of well-known functions and constructions may be omitted for increased clarity and conciseness.

Furthermore, the terms used herein are intended to describe embodiments only and shall by no means be restrictive. Unless clearly used otherwise, expressions in a singular form include a meaning of plural form. An expression such as "comprising" or "including" is intended to designate a characteristic, a number, a step, an operation, an element, a part or combinations thereof, and shall not be construed to preclude any presence or possibility of one or more other characteristics, numbers, steps, operations, elements, parts or combinations thereof.

Figure 1:
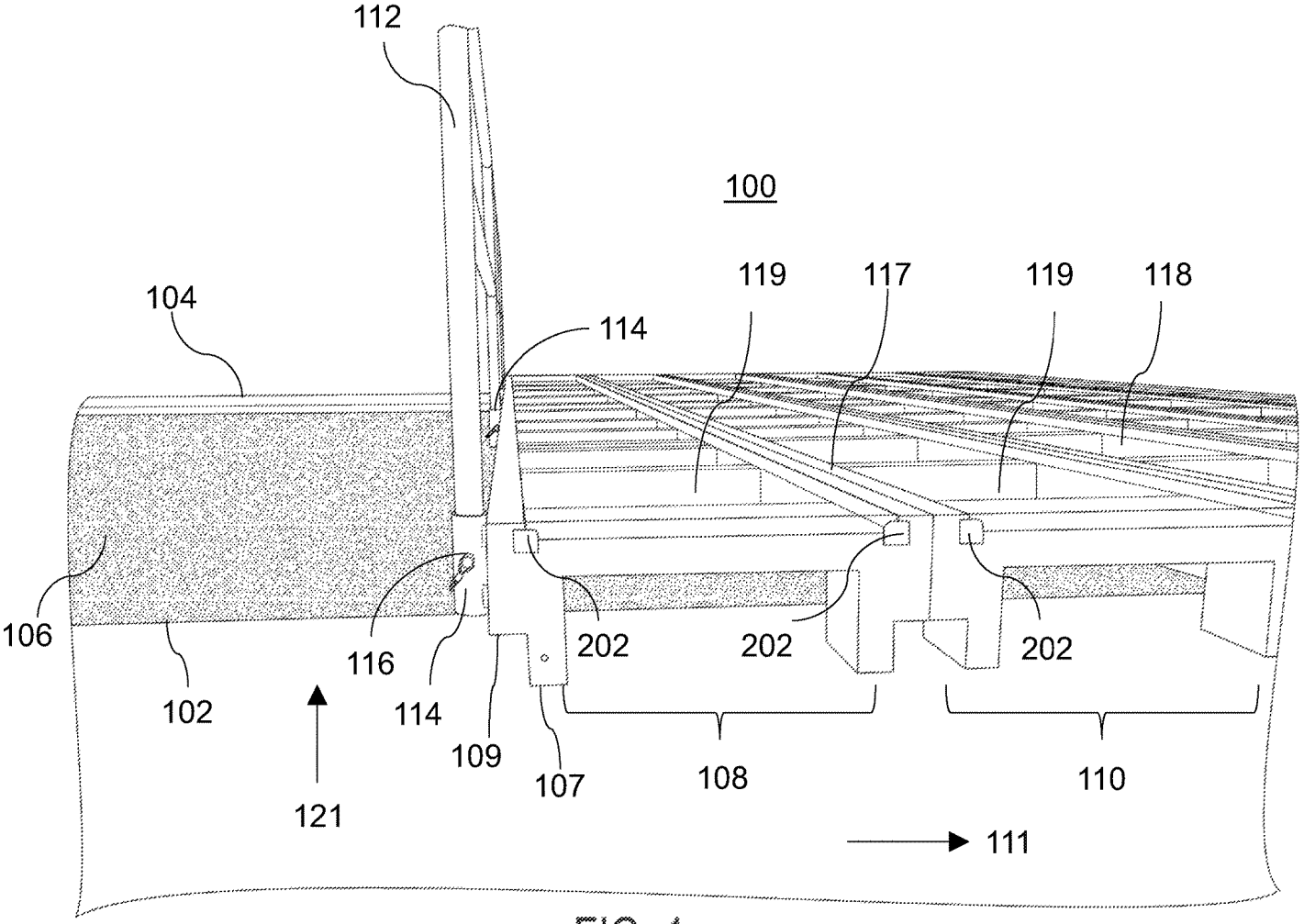
FIG. 1 illustrates a view of a modular structure according to various aspects of one or more embodiments described herein.

FIG. 1 illustrates a view of a structure 100 according to an embodiment. In its fully assembled form, the structure 100 may extend from a first edge 102 to a second edge 104. In one use case, the first edge 102 and the second edge 104 may be part of the perimeter of a pool. In yet other use cases, the first edge 102 and the second edge 104 may be the edges of a canal or of a small gap recessed into the ground. In general, one of skill in the art will readily recognize that the structure 100 can be used without a pool, i.e., generally, that it can be used to extend over a gap without departing from the teachings presented herein.

In an embodiment where the structure 100 extends over a pool, the water 106 is underneath the structure 100, and the water 106 may be visible from atop and through the structure 100, as shall be explained in greater detail below. The structure 100 may include a plurality of sections of which sections 108 and 110 are shown. The sections may be disposed one next to the other, extending in a direction 111. In the embodiment shown in FIG. 1, there may be a rail 112 mounted on the side of the section 108. The rail 112 may be secured at different locations on the side of the section 108, for example, at fixtures 114 which are configured to receive an end of the rail 112. The rail 112 may be removably secured on the side of the section 108 in the fixtures 114 using fasteners 116. Furthermore, in addition or instead of the rail 112, a tent or the like may be mounted on the structure 100 utilizing the fixtures 114 serving as a base for support beams of the tent. In such a case, the structure 100 is covered and guests can thus sit on the structure 100 without being exposed to sunlight or to rain.

Each one of the sections 108 and 110 may include a set of longitudinal members 117 that are joined by a set of transversally-disposed lateral members 119. These members may be welded to the inner side of the longitudinal members 11. Furthermore, the transversally-disposed set of lateral members 119 extend in a direction 121 that is orthogonal to the direction 111. Together, the set of transversally-disposed lateral members 119 form a set of section tiles 118 in each of the sections of the plurality of sections that form the structure 100 (e.g., the section 108 or section 110). Further, in one embodiment, each of the section tiles 118 can be modular. In other words, the sections tiles 118 can be tiled together in the direction 121 to make up a section of the structure 100. Such an embodiment is described in greater detail below with respect to FIG. 9.

Each section includes a foot that is form by a portion 107 and a portion 109. In one embodiment, each foot of the structure 100 forms a passive structure that may be inserted in a recess or a hole formed in the ground (e.g., at specific locations on each of the first edge 102 and the second edge 104), the recess or hole having the corresponding depth and shape to match the portion 109 and the portion 107. As such, the feet of each section can further help secure the structure 100 when it is fully assembled over a pool.

Generally, each feet can be used to anchor the structure 100 on the ground on each side of the pool. This may be done, for example with a locking mechanism. It is noted that while locking may be a feature, it is not required. For example, as shown and as has been demonstrated in current prototypes of the structure 100, the sheer weight of the structure 100 is enough to hold it in place when the structure 100 is simply placed on the side of a pool, as shown in the accompanying drawings.

Figure 2:
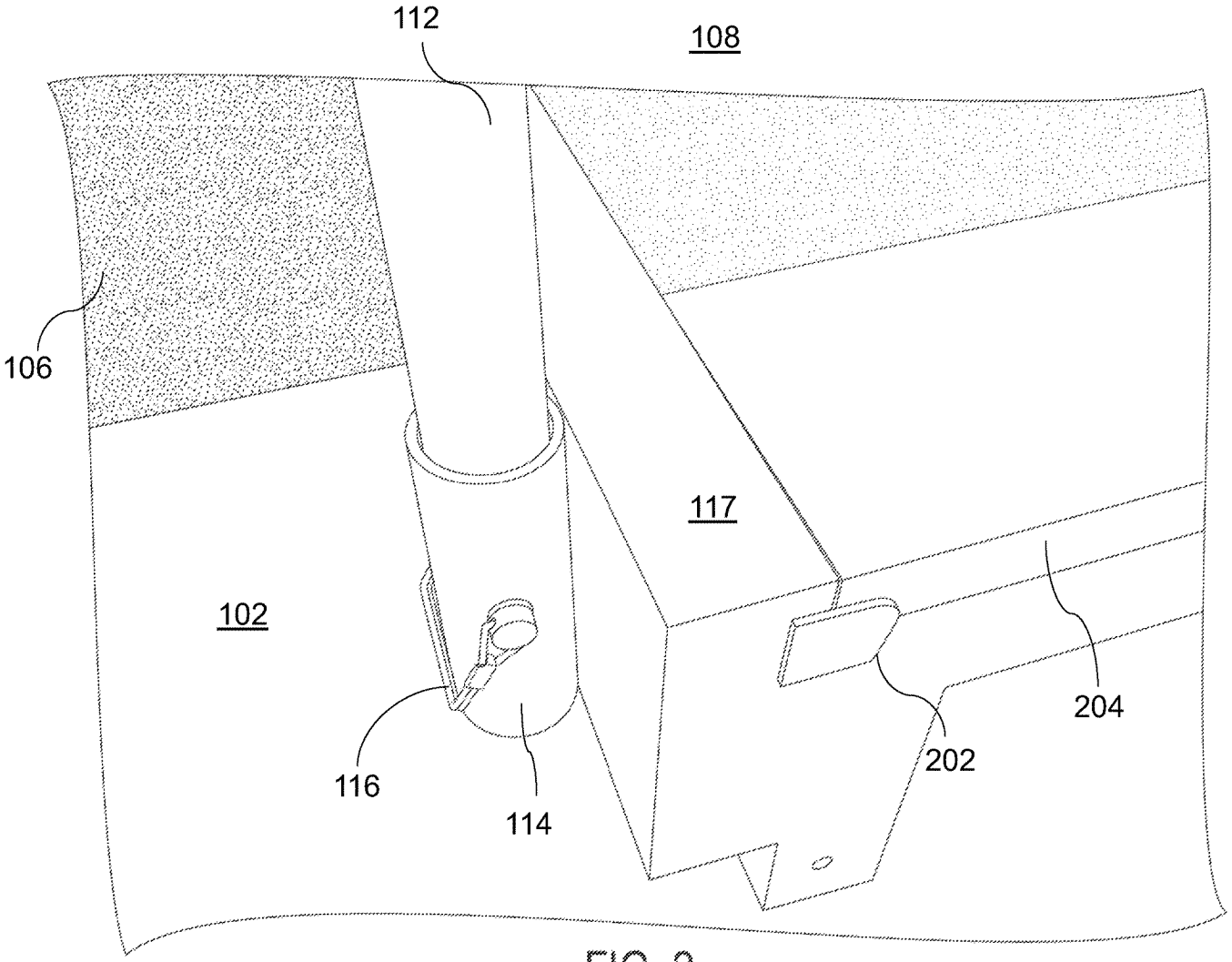
FIG. 2 illustrates a view of a modular structure according to various aspects of one or more embodiments described herein.

FIG. 2 illustrates a view 200 of a corner section of a section tile 118 of the section 108. The view 200 shows a close-up of the fixture 114, along with the fastener 116. The section 108 includes a set of stops 202 at the end of the longitudinal members 117 of which only the left-most member is shown. The longitudinal member 117 may be equipped with a stop 202 whose function is to secure a slab 204 on top of the frame of the structure 100. As such, the slab 204 is secured on the structure 100 without any screws, fasteners, or the like. In one embodiment, the slab 204 may be an at least one-inch thick PLEXIGLAS® sheet. In such an embodiment, the set of slabs 204 form a transparent surface, thereby allowing a person standing on the structure 100 to see the water 106. In other words, when the slab 204*s* are transparent, they provide an aesthetic appeal to the structure 100, without compromising structural integrity or functionality.

Furthermore, a slab 204, as shown in FIG. 2 may have a first edge that begins at a location coinciding with a first lateral member 119 and second edge that ends at a location coinciding with a second lateral member 119. In some embodiments, the first and second lateral members 119 may be adjacent members. In other embodiments, the first and second lateral members 119 may have one or more lateral members disposed in between them. As such, for example, and without limitation, a slab 204 of PLEXIGLAS® sheet may be cut so that it extends two lateral members 119, or it may be cut so that it extends four lateral members 119. Generally, a lateral member 119 that is not at the end of the section 108 may serve as support for the second edge of a first slab 204 and the first edge of a second slab 204. For instances, the two slabs 204 may each have an edge that extends over half of the same lateral member 119 and the two edges may abut so as to make a continuous slab formed from the two slabs 204.

Figure 3:
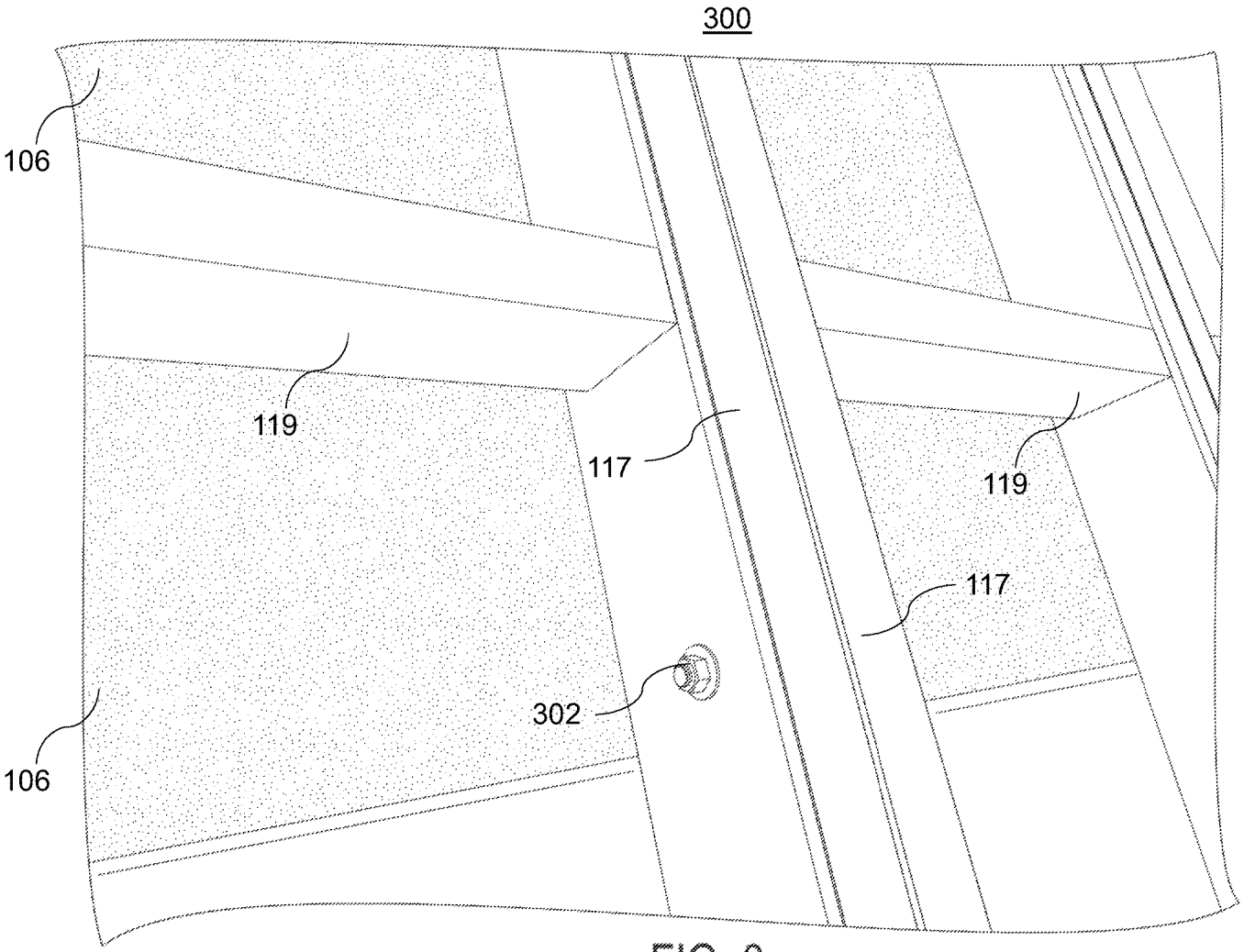
FIG. 3 illustrates a view of a modular structure according to various aspects of one or more embodiments described herein.
Figure 4:
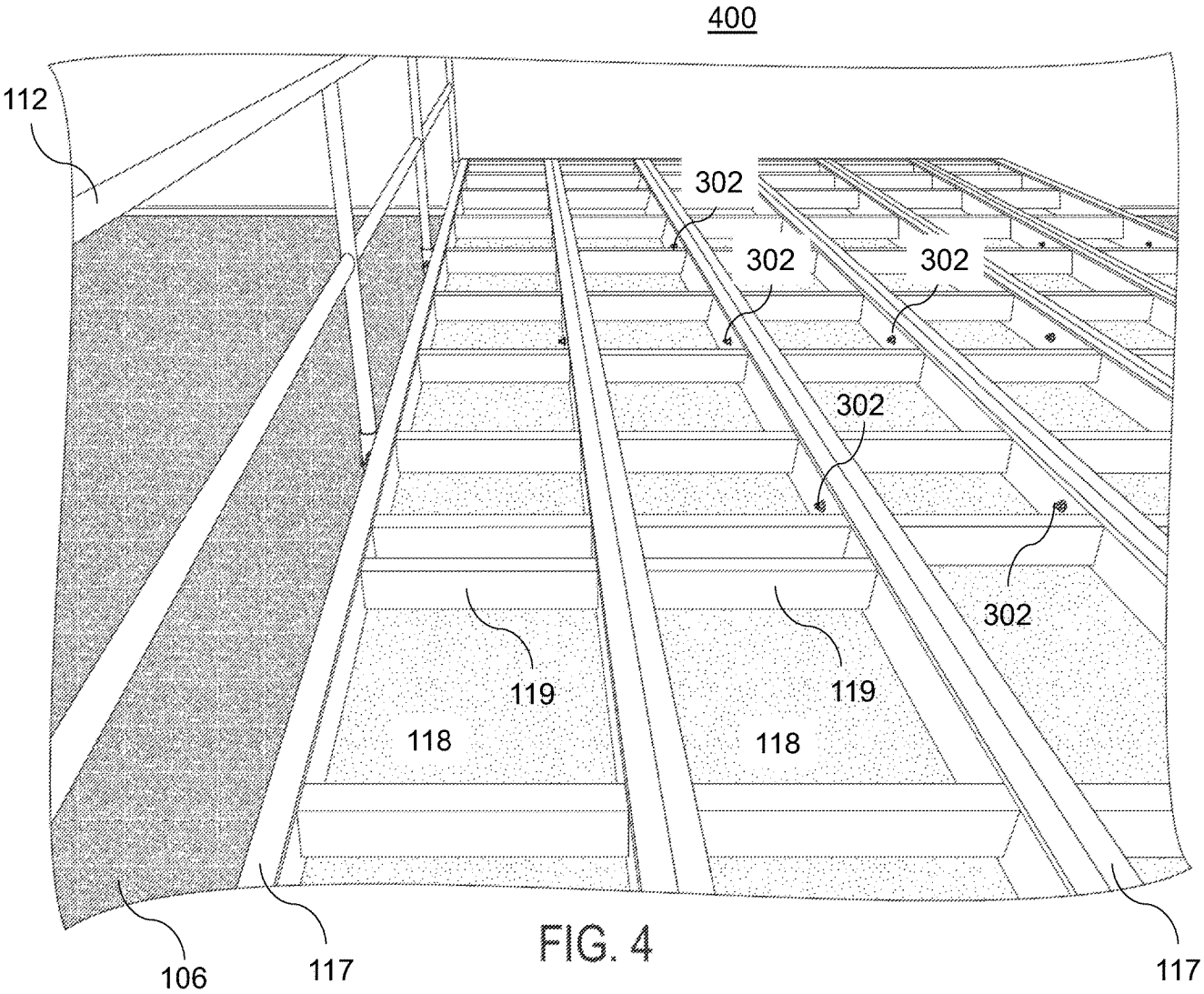
FIG. 4 illustrates a view of a modular structure according to various aspects of one or more embodiments described herein.
Figure 5:
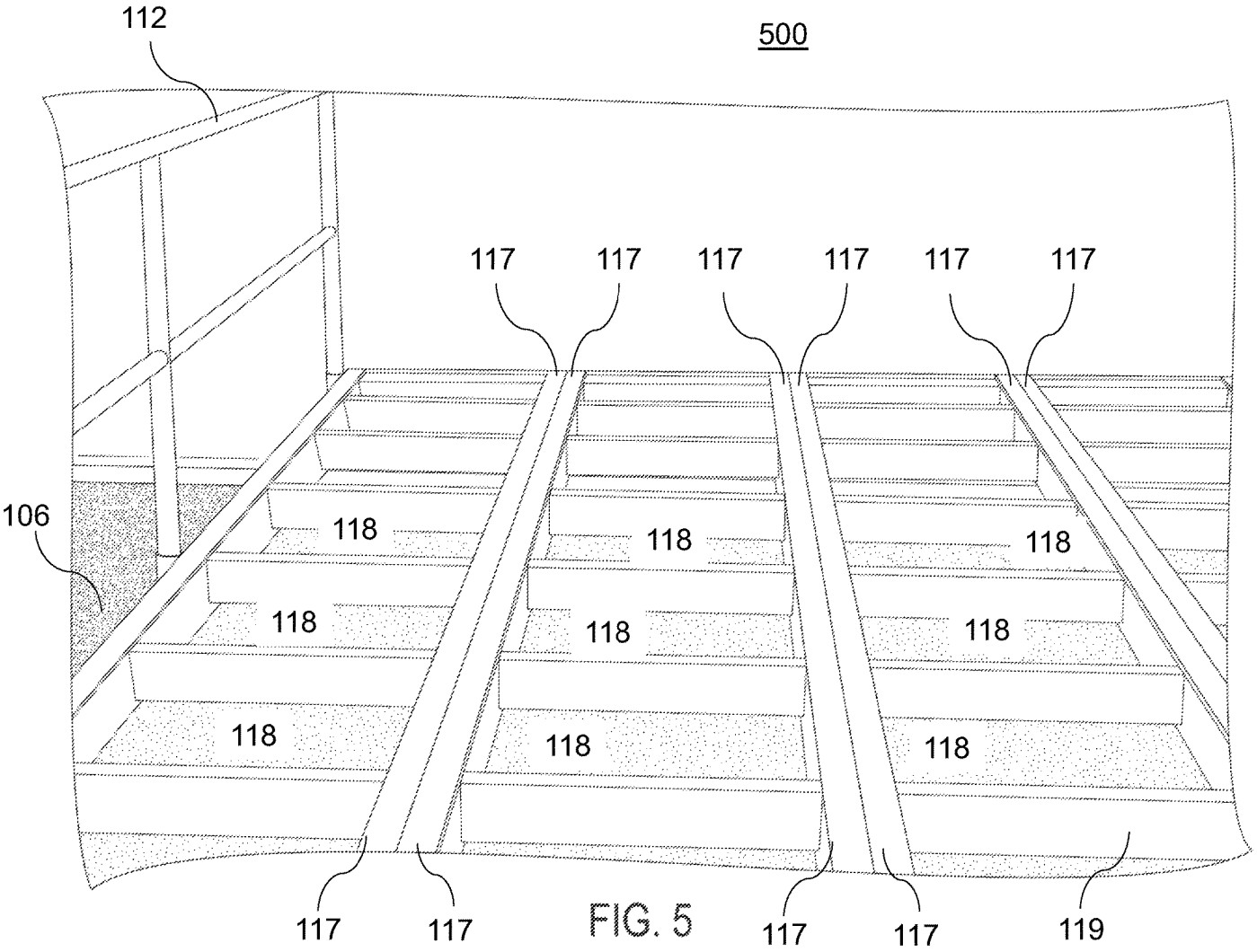
FIG. 5 illustrates a view of a modular structure according to various aspects of one or more embodiments described herein.
Figure 6:
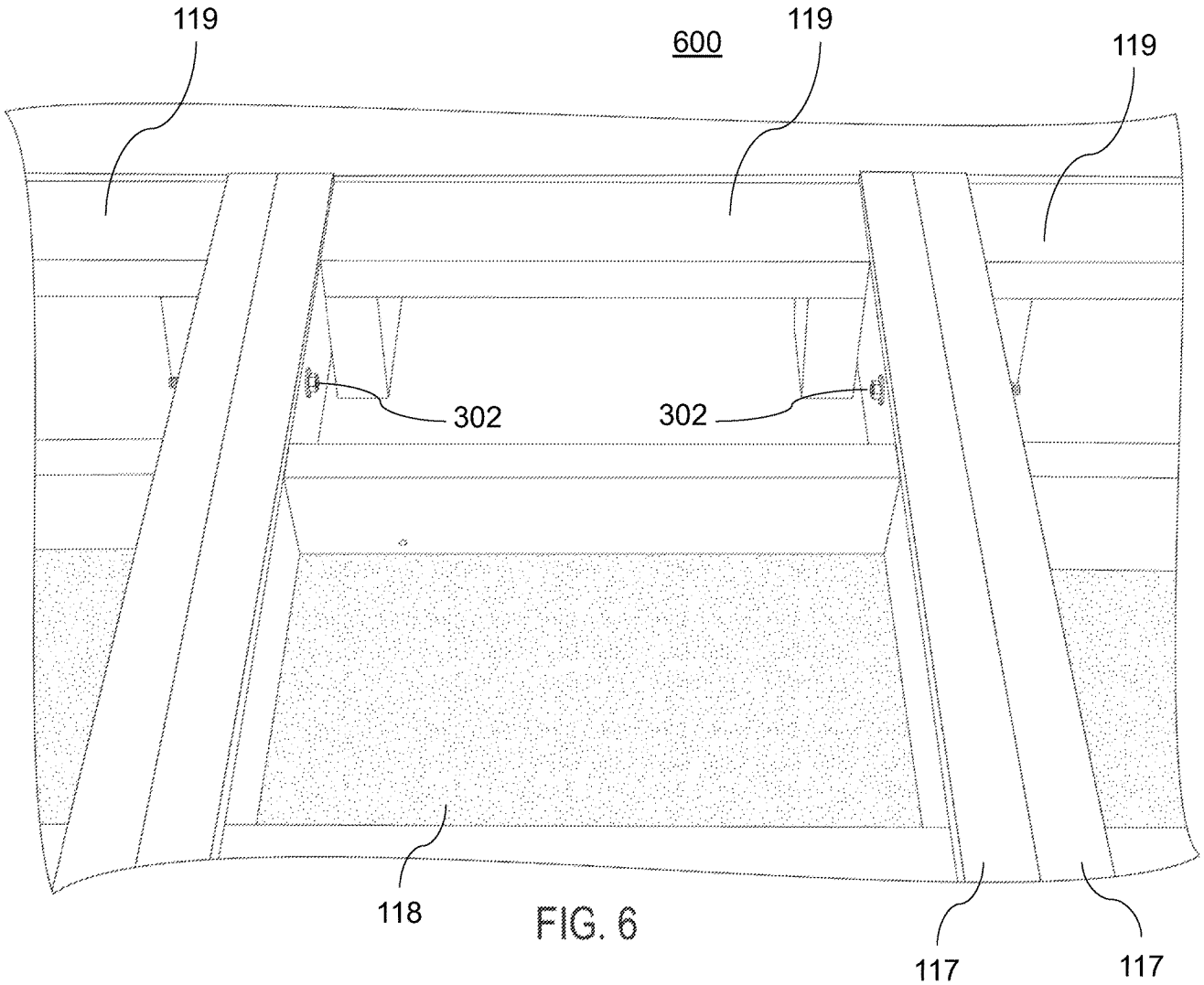
FIG. 6 illustrates a view of a modular structure according to various aspects of one or more embodiments described herein.
Figure 7:
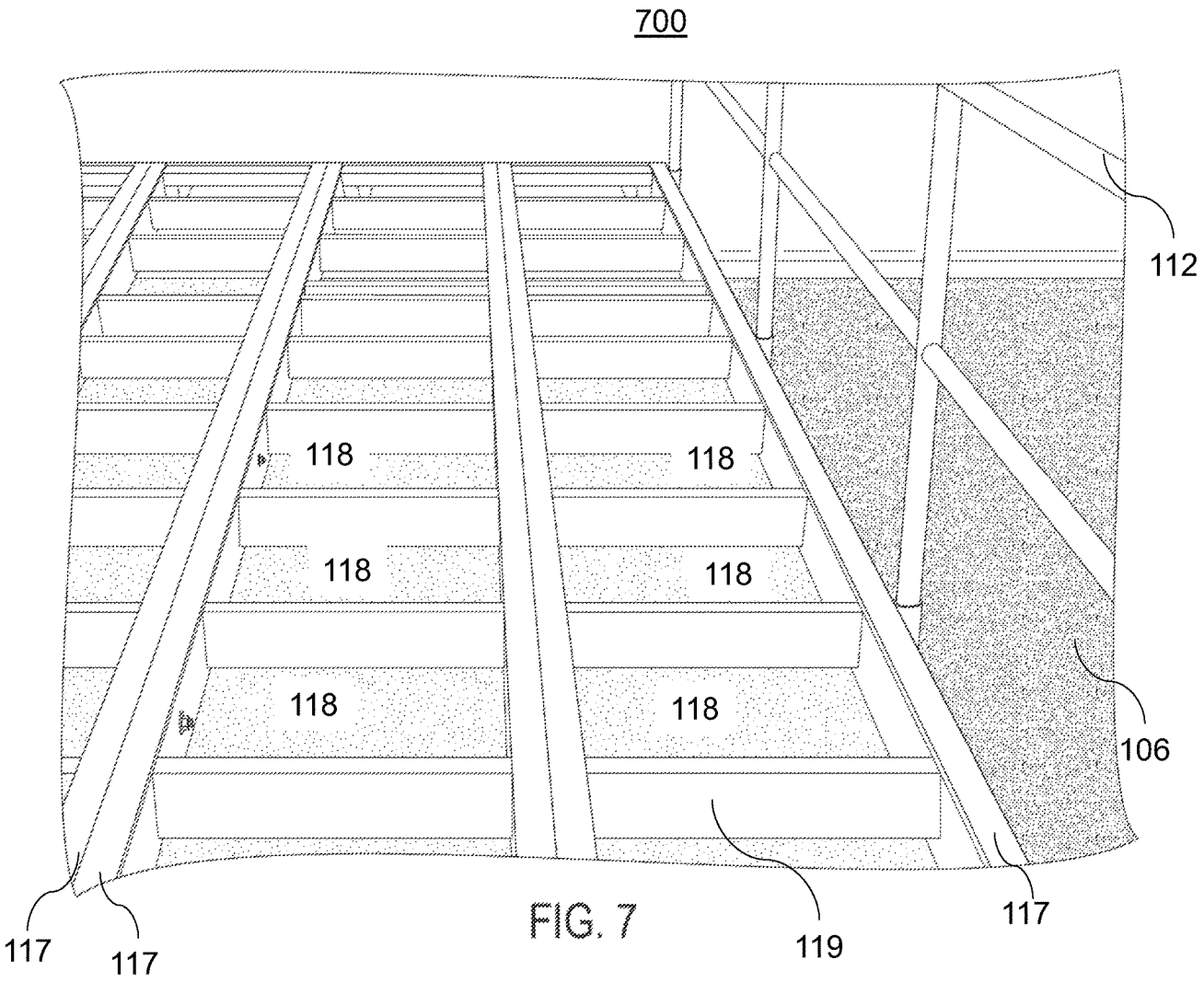
FIG. 7 illustrates a view of a modular structure according to various aspects of one or more embodiments described herein.
Figure 8:
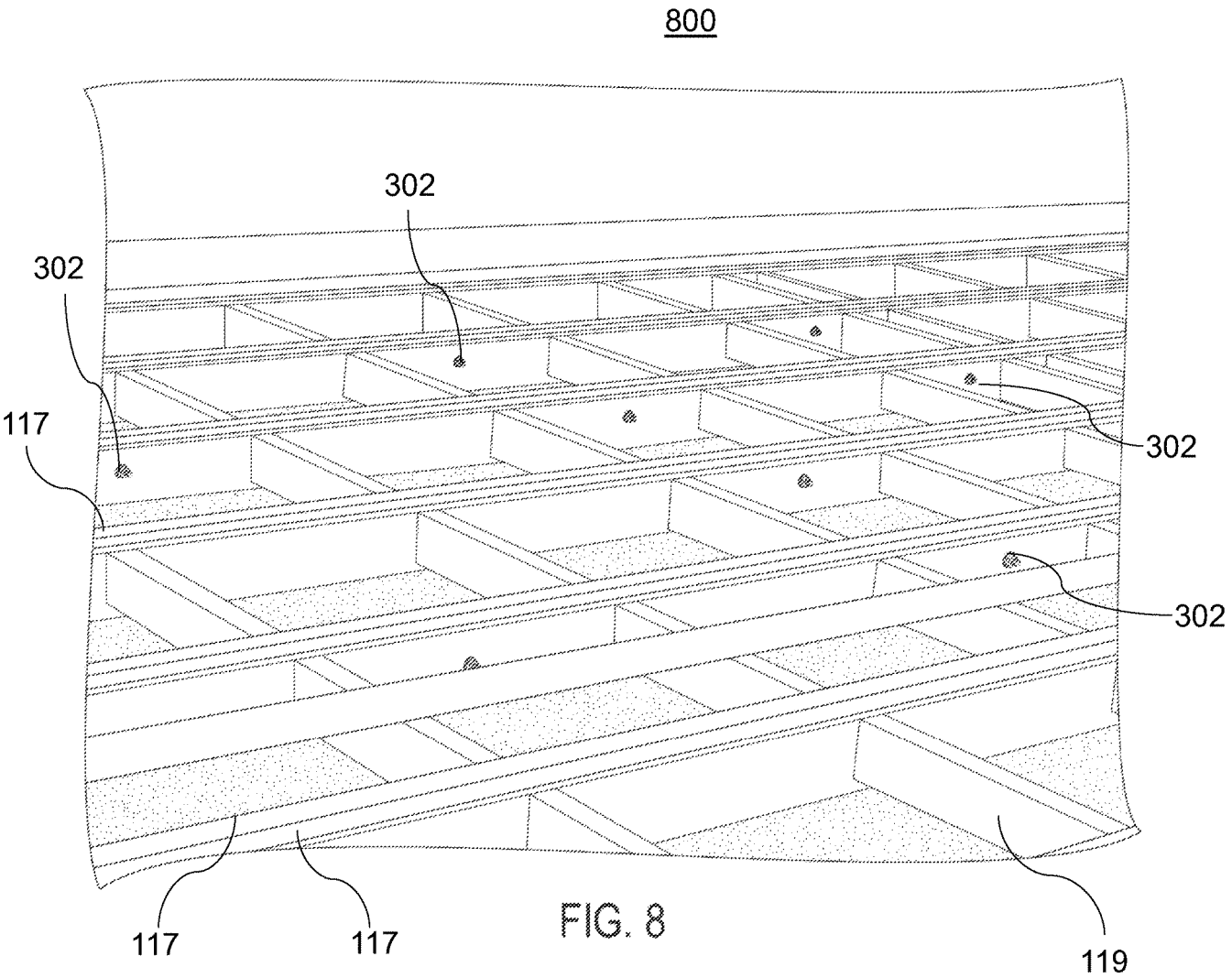
FIG. 8 illustrates a view of a modular structure according to various aspects of one or more embodiments described herein.

FIG. 3 illustrates another view 300 of the structure 100. Specifically, the view 300 illustrates how different sections may be secured together to extend the structure 100 in the direction 111. A set of bolts 302 (and associated screws and knots) may be used to secure one longitudinal member 117 of a first section to a longitudinal member 117 of another section. The bolts 302 may be set equidistantly in the direction 121. In other embodiments, equidistance may not be a feature.

In FIGS. 4-8, several views (400, 500, 600, 700, and 800) of the structure 100 are shown. Generally, the structure 100 may include a first section secured to a second section at at least two locations. Each of the first section and the second section may include two longitudinal members joined by a set of transversally-disposed lateral members. Furthermore, the first section and the second section further includes a set of transparent members disposed in a longitudinal direction overtop the set of transversally-disposed lateral members. Furthermore, the set of transparent members form a continuous platform secured by a set of stops disposed at each end of the two longitudinal members. The first and second section may be secured using a set of bolts, pins, screws, or combinations thereof.

The two longitudinal members may be made of an aluminum alloy. Further, the set of transversally-disposed members includes a plurality metal bars that may be made of an aluminum alloy. Furthermore, the set of transparent members include a plurality of plastic slabs. In one embodiment, the plurality of plastic slabs are made of PLEXIGLAS®. The plurality of plastic slabs are at least one inch-thick. In one embodiment, the first section and the second section includes a set of receptacles configured to fit a side rail, which may be made of the same material as that of the longitudinal members. For example, the side rail may be made of an aluminum alloy.

In yet another embodiment, an end of a first plastic slab and an end of a second plastic slab from the plurality of plastic slabs may be made to contact each other without any intervening fasteners, bolts, or screws. In such an embodiment, the end of the first plastic slab and the end of the second plastic slabs may be disposed on a metal bar from the set of transversally-disposed members, the two end surfaces of each slab may be mated without using any screws, fasteners, or bolts.

The two longitudinal members may each include a fixture configured to secure the modular structure on a side of the pool. The fixture is located at an extremity of each of the two longitudinal members. In another embodiment, each of the two longitudinal members may include a fixture configured to provide an interface between the modular structure and a sliding rail disposed on a side of the pool. The fixture may further include a mechanism configured to lock the structure in a fixed position on the sliding rail when engaged and to unlock the structure from the fixed position when disengaged.

The structure may include additional sections that are similarly configured to the first and second sections. The structure can include a set of equidistant locations at which the first and second sections are secured. And the structure may be set forth at the set of equidistant locations using a set of bolts, a set of washers, and a set of nuts. In one embodiment, the two longitudinal members may be configured to provide electrical power at one or more power outlets disposed along each of the two longitudinal members.

Figure 9:
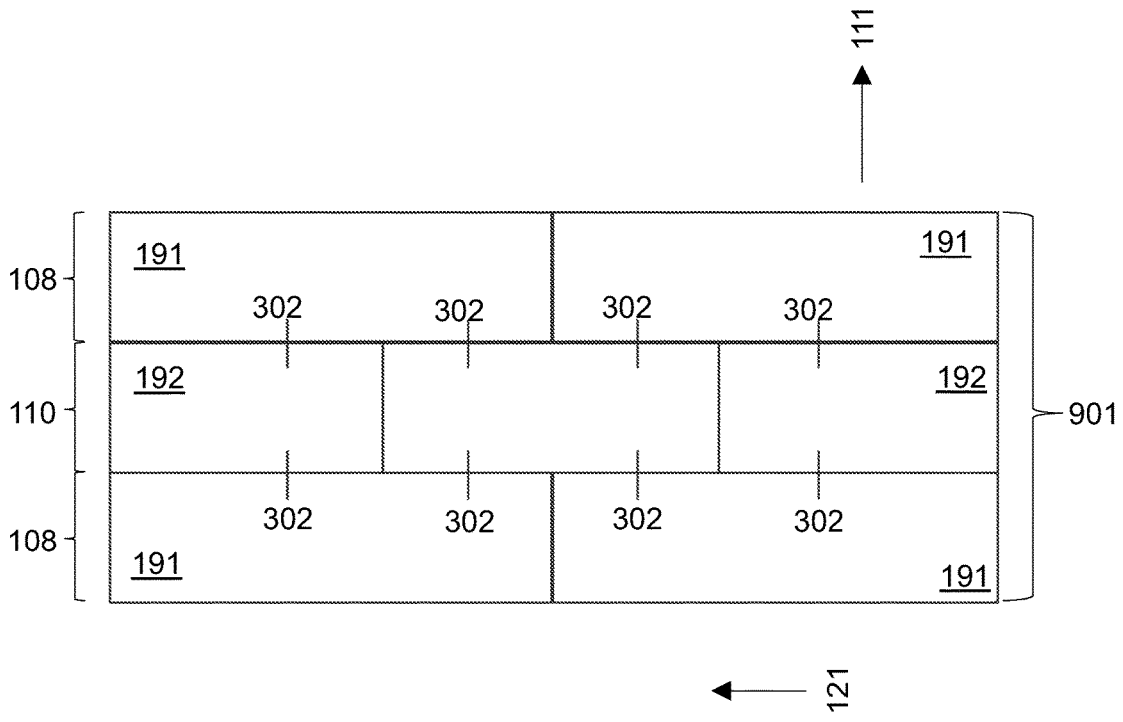
FIG. 9 illustrates a view of a modular structure according to various aspects of one or more embodiments described herein.

FIG. 9 illustrates an example layout 900 providing increased modularity for the structure 100. In this configuration, the structure 100 includes a set of tiles that can be assembled together to make, for example, a section 108 that includes a longitudinal member 117 formed of several tiles. In this embodiment, increased modularity is achieved by partitioning each longitudinal member 117 in several sections. For example, the section 108, forming the left most edge of the structure 100 in FIG. 1 can be made with a set of tiles 191. Further, in the layout 900, the longitudinal member 117 of the section 110 adjacent to the section 108 may also be modularized with a set of tiles 192. Furthermore, the section 110 may be, as shown in the layout 900, sandwiched between two modular sections 108, each having been formed with sets of tiles 191. This arrangement of three sections can make a unit tile 901, with which the entire structure 100 may be made. The various tiles of the unit tile 901 can be secured together with a mechanism 1000 as will be described below with respect to FIG. 10.

In one embodiment, the structure 100 may be built using a set of unit tiles 901. In another embodiment, the structure 100 may be built using a set of unit tiles 901 such that a first end section of the structure 100 (e.g., the left-most section) is made with a modular longitudinal member 117 that includes a set of tiles 191 and such that a second end section of the structure 100 (e.g., the right-most section) is made with another modular longitudinal member 117 that includes a set of tiles 191. In other words, the tiles making up a section may not have the same length relative to the tiles that make up another section, while the total length of each section remains the same.

Generally, an embodiment can include an arrangement of tiles such that at least two longitudinal members 117 are made using a first number of tiles (e.g. the tiles 191), and at least one longitudinal member 117 is made of a second umber of tiles (e.g., the tiles 192), where the first number is different than the second number. Still, generally, an embodiment can consist of an arrangement such that a unit tile like the unit tile 901 includes at least two longitudinal members made with a different number of tiles relative to one another. As shown in FIG. 9, the layout 900 shows an arrangement in which a section 110 has two tiles 191 and a section 108 has three tiles 192. This arrangement has the advantage of providing increased modularity, without compromising structural integrity or the maximum load that the structure 100 can withstand.

Figure 10:
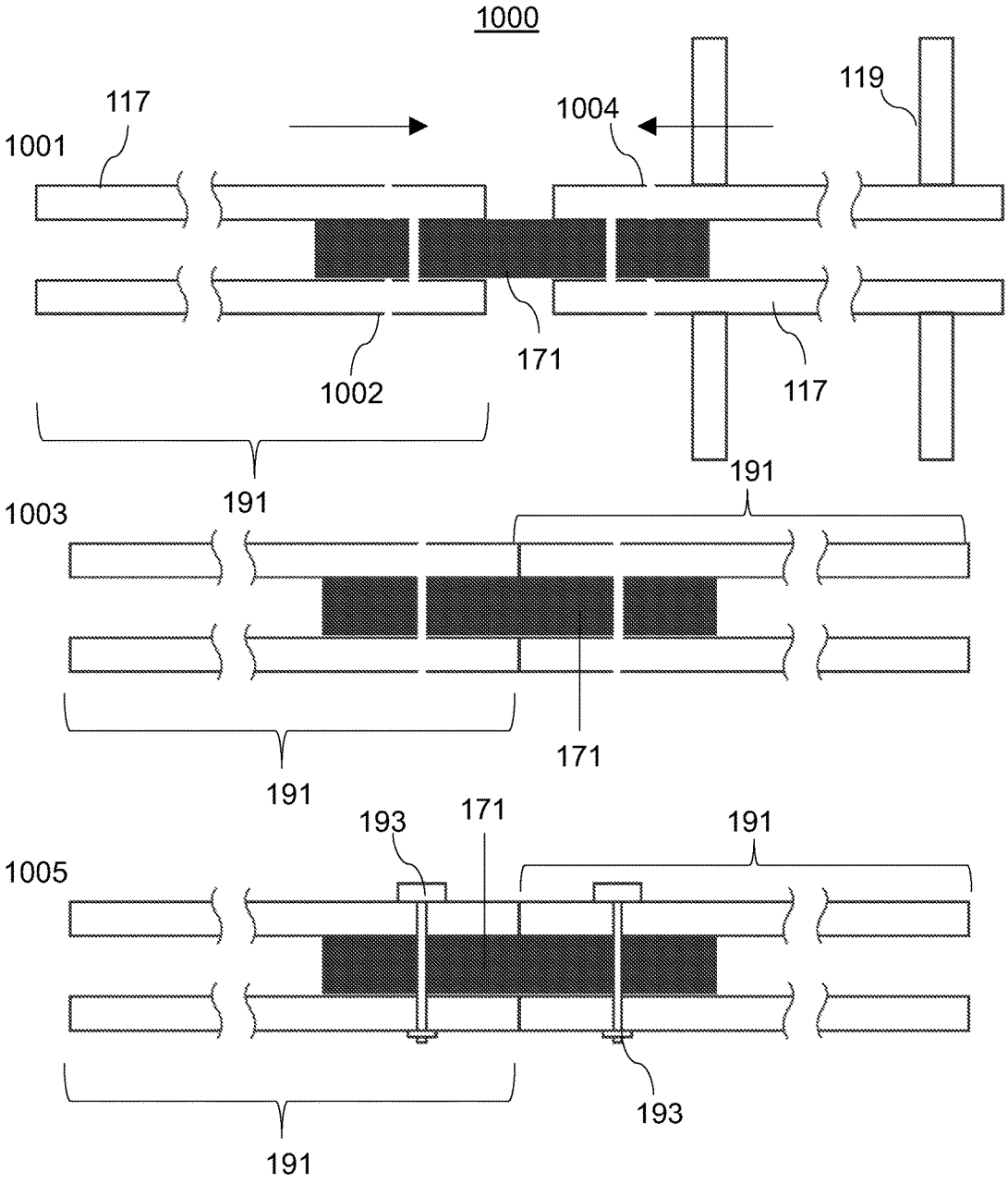
FIG. 10 illustrates a view of a modular structure according to various aspects of one or more embodiments described herein.

FIG. 10 illustrates a mechanism 1000 for securing two tiles 191 included in a longitudinal member 117 of a section 110. It is noted that the mechanism 1000 can also be applied to a longitudinal member made from tiles 192, without departing from the scope of the present disclosure. The panel 1001 shows a first phase of mounting two tiles 191 together to form a modular longitudinal member 117. In this embodiment, the beams forming the longitudinal members of the structure 100 are hollow. For example, the two tiles 191 shown in FIG. 10 may be made from a hollow aluminum alloy beam having a square or a rectangular cross-section. Each beam may have a hole with openings disposed on either side of the beam (e.g. the hole 1002 and hole the 1004). A solid beam 171, i.e. a non-hollow beam, may be inserted in a first tile 191 at one end and in a second tile 191 at another end. The solid beam 171 may be relatively shorter than the beams forming each of the tiles 191. Furthermore, the solid beam 171 may have holes disposed therein, extending from one side of the solid beam to 171 to the other side of the solid beam 171. When assembling the two tiles 191 together, as shown in the panel 1001, the solid beam 171 is inserted within the two tiles 191, and the two tiles 191 are moved towards one another, each in the direction of the arrows shown.

The panel 1003 shows the assembly when the two tiles 191 are fitted with the solid beam 171 and their two ends are abutting. In this situation, the holes 1002 and 1004 of the respective tiles 191 line up with the holes of the solid beam 171 on either side. Then, as shown in the panel 1005, a set of bolts 193 (and associated knots) can be used to secure the two tiles 191 together. As such, the mechanism 1000 serves to increase the modularity of the structure 100, which in turn, allows custom configurations to be achieved.

For example, and without limitation, a configuration can include only two unit tiles 901, with the rail 112 mounted on each side of the end sections 110. Another configuration can include six unit tiles 901, tiled one after the other in the direction 111, to cover a larger space. Furthermore, generally, the unit tiles 901 can be fitted with as many tiles as needed in the direction 121 in order to extend over a pool's width or length. Moreover, it is noted that the set of bolts 193 can also function as the bolts 302 to secure tiles of the longitudinal members of two adjacent sections together (as shown in FIG. 9).

Although the drawings describe operations in a specific order and/or show specific arrangements of components and are described in the context of structures for swimming pools, one should not interpret that such specific order and/or arrangements limit the scope of the present disclosure, or that all the operations performed and the components disclosed are needed to obtain a desired result. One or more exemplary embodiments are described below in regards to the appending claims.

The invention claimed is:

1. A structure for extending over a pool, the structure comprising:

a first section secured to a second section at at least two locations, wherein each of the first section and the second section includes two longitudinal members joined by a set of transversally-disposed lateral members, wherein each of the first section and the second section further includes a set of transparent members disposed in a longitudinal direction overtop the set of transversally-disposed lateral members, and wherein the set of transparent members form a continuous platform secured by a set of stops disposed at each end of the two longitudinal members.

2. The structure as set forth in claim 1, wherein two longitudinal members are made of an aluminum alloy.

3. The structure as set forth in claim 1, wherein the set of transversally-disposed members include a plurality metal bars.

4. The structure as set forth in claim 3, wherein the plurality of metal bars are made of an aluminum alloy.

5. The structure as set forth in claim 1, wherein the set of transparent members include a plurality of plastic slabs.

6. The structure as set forth in claim 5, wherein the plurality of plastic slabs are made of PLEXIGLAS®.

7. The structure as set forth in claim 6, wherein the plurality of plastic slabs are at least one inch-thick.

8. The structure as set forth in claim 5, wherein an end of a first plastic slab and an end of a second plastic slab are in contact without any intervening fasteners, bolts, or screws.

9. The structure as set forth in claim 8, wherein the end of the first plastic slab and the end of the second plastic slabs are disposed on a metal bar from the set of transversally-disposed members.

10. The structure as set forth in claim 1, wherein one of the first section and the second section includes a set of receptacles configured to fit a side rail.

11. The structure as set forth in claim 10, wherein the side rail is made of an aluminum alloy.

12. The structure as set forth in claim 1, wherein the first section and the second section are secured at the at least two locations using a set of bolts.

13. The structure as set forth of claim 1, wherein each of the two longitudinal members includes a fixture configured to secure the structure on a side of the pool.

14. The structure as set forth in claim 13, wherein the fixture is located at an extremity of each of the two longitudinal members.

15. The structure as set forth in claim 1, wherein each of the two longitudinal members includes a fixture configured to provide an interface between the structure and a sliding rail disposed on a side of the pool.

16. The structure as set forth in claim 15, wherein the fixture further includes a mechanism configured to lock the structure in a fixed position on the sliding rail when engaged and to unlock the structure from the fixed position when disengaged.

17. A structure for extending over a pool, the structure comprising a first section secured to a second section, wherein each of the first section and the second section includes two longitudinal members joined by a set of transversally-disposed lateral members, wherein each of the first section and the second section further includes a set of transparent slabs disposed in a longitudinal direction overtop the set of transversally-disposed lateral members, wherein the set of transparent slabs form a continuous platform secured by a set of stops disposed at each end of the two longitudinal members, wherein the first section includes a first number of tiles extending in a first direction, wherein the second section includes a second number of tiles extending in the first direction, and wherein the first number of tiles is different than the second number of tiles.

18. The structure as set forth in claim 17, wherein the two longitudinal members are hollow.

19. The structure as set forth in claim 18, wherein a first tile in the first number of tiles and a second tile in the first number of tiles are joined using a solid beam having a first portion disposed within the first tile and a second portion disposed with the second tile.

20. The structure as set forth of claim 19, wherein the solid beam is bolted at at least one location on the first tile and at at least one location on the second tile.

* * * * *